US011573044B2

(12) United States Patent
Mori et al.

(10) Patent No.: US 11,573,044 B2
(45) Date of Patent: Feb. 7, 2023

(54) REFRIGERATOR

(71) Applicant: Panasonic Intellectual Property Management Co., Ltd., Osaka (JP)

(72) Inventors: Kiyoshi Mori, Shiga (JP); Kei Nambu, Kyoto (JP); Tsuyoki Hirai, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 276 days.

(21) Appl. No.: 17/040,813

(22) PCT Filed: Mar. 29, 2019

(86) PCT No.: PCT/JP2019/014066
§ 371 (c)(1),
(2) Date: Sep. 23, 2020

(87) PCT Pub. No.: WO2019/202953
PCT Pub. Date: Oct. 24, 2019

(65) Prior Publication Data

US 2021/0018246 A1 Jan. 21, 2021

(30) Foreign Application Priority Data

Apr. 18, 2018 (JP) ..... JP2018-079500

(51) Int. Cl.
*F25D 11/02* (2006.01)
*F25D 31/00* (2006.01)
(Continued)

(52) U.S. Cl.
CPC ..... *F25D 11/02* (2013.01); *F25D 31/005* (2013.01); *F25D 23/02* (2013.01); *F25D 29/00* (2013.01);
(Continued)

(58) Field of Classification Search
CPC .. F25D 11/02; F25D 31/005; F25D 2317/061; F25D 17/065; H05B 6/76
See application file for complete search history.

(56) References Cited

FOREIGN PATENT DOCUMENTS

CN 87207535 U 12/1987
CN 2302484 Y 12/1998
(Continued)

OTHER PUBLICATIONS

English Translation of Chinese Search Report dated Jul. 15, 2021 for the related Chinese Patent Application No. 201980025768.5, 3 pages.

(Continued)

*Primary Examiner* — Ana M Vazquez
(74) *Attorney, Agent, or Firm* — Hamre, Schumann, Mueller & Larson, P.C.

(57) ABSTRACT

A refrigerator according to the present disclosure includes at least one storage chamber and uses an electromagnetic wave to heat a stored object inside the storage chamber. A first electromagnetic wave shield is provided on a door of the storage chamber, and a second electromagnetic wave shield is provided on a housing part of the refrigerator that is in contact with the door while the door is closed. This makes it possible to provide a structure capable of exhibiting a function as an electromagnetic wave shield even for a refrigerator door in which wiring to a grounding part is difficult.

15 Claims, 18 Drawing Sheets

(51) Int. Cl.
*F25D 23/02* (2006.01)
*F25D 29/00* (2006.01)

(52) U.S. Cl.
CPC ..... *F25D 2600/02* (2013.01); *F25D 2700/02* (2013.01)

(56) References Cited

FOREIGN PATENT DOCUMENTS

| | | | | |
|---|---|---|---|---|
| CN | 104567178 | A | | 4/2015 |
| CN | 106288626 | A | * | 1/2017 |
| CN | 106288626 | A | | 1/2017 |
| CN | 109000420 | A | * | 12/2018 |
| JP | 53-104463 | A | | 9/1978 |
| JP | 63-057490 | U | | 4/1988 |
| JP | 5-332546 | A | | 12/1993 |
| JP | 2002-147919 | A | | 5/2002 |
| JP | 2008-106994 | A | | 5/2008 |
| JP | 2014-159896 | A | | 9/2014 |
| JP | 2017-182885 | A | | 10/2017 |

OTHER PUBLICATIONS

International Search Report issued in International Application No. PCT/JP2019/014066, dated Jun. 11, 2019, 5 pages with translation.

* cited by examiner

| MELTING RATE | 20% | 40% | 60% | 80% | 100% |
|---|---|---|---|---|---|
| EASE OF CUTTING (SENSORY EVALUATION) | POOR | FAIR | GOOD | GOOD | GOOD |
| DRIP AMOUNT | GOOD | GOOD | GOOD | FAIR | POOR |

<EASE OF CUTTING>
POOR: FEMALE CANNOT CUT
FAIR: FEMALE CAN CUT WITH FORCE
GOOD: FEMALE CAN CUT WITH ONE HAND

<DRIP AMOUNT>
POOR: LIQUID POOL IS GENERATED
FAIR: SMALL AMOUNT IS GENERATED
GOOD: VERY SMALL AMOUNT IS GENERATED

REFRIGERATOR

This application is a U.S. national stage application of the PCT International Application No. PCT/JP2019/014066 filed on Mar. 29, 2019, which claims the benefit of foreign priority of Japanese patent application No. 2018-079500 filed on Apr. 18, 2018, the contents all of which are incorporated herein by reference.

TECHNICAL FIELD

The present invention relates to a refrigerator that uses electromagnetic waves to heat a stored object.

BACKGROUND ART

In recent years, there has been a growing need for thawing stored objects such as foodstuff kept frozen and frozen food in a short time in refrigerators. PTL 1 discloses a refrigerator including a heating chamber that uses microwaves to heat a stored object.

Further, PTL 2 discloses a high frequency heater that thaws a stored object using high frequency waves in a HF to VHF band instead of microwaves. Unlike microwaves, the high frequency waves in the HF to VHF band have high rectilinearity, and form an electric field between two electrodes to heat the stored object.

CITATION LIST

Patent Literature

PTL 1: Unexamined Japanese Patent Publication No. 2002-147919

PTL 2: Unexamined Japanese Patent Publication No. 2017-182885

SUMMARY OF THE INVENTION

When a stored object is heated using electromagnetic waves, it is necessary to take measures to prevent the electromagnetic waves from leaking outside. In order to prevent the electromagnetic waves from leaking to outside, it is common to provide an electromagnetic wave shield and ground the electromagnetic wave shield. However, it is difficult to ground the electromagnetic wave shield provided on a door that moves in a front and rear direction, such as a refrigerator door. This is because wiring that runs between the electromagnetic wave shield provided on the door of the refrigerator and a grounding part may be disconnected because of being repeatedly bent and extended due to opening and closing of the door.

An object of the present invention is therefore to provide a structure capable of exhibiting a function as an electromagnetic wave shield even for a refrigerator door in which wiring to the grounding part is difficult.

In order to solve the above-mentioned problem, the refrigerator provided by the present invention includes at least one storage chamber, in which the refrigerator heats a stored object inside the storage chamber using an electromagnetic wave, the storage chamber includes a door provided with a first electromagnetic wave shield, and the refrigerator includes a housing part provided with a second electromagnetic wave shield, the housing part being in contact with the door while the door is closed.

The present invention makes it possible to provide a structure capable of exhibiting a function as an electromagnetic wave shield even for a refrigerator door in which wiring to a grounding part is difficult.

DESCRIPTION OF EMBODIMENTS

Exemplary embodiments of the present invention will be described below with reference to the drawings. Note that the following exemplary embodiments do not limit the invention according to the claims, and all combinations of the characteristics described in the exemplary embodiments are not necessarily essential to the means for solving the invention.

First Exemplary Embodiment

Figure 1:
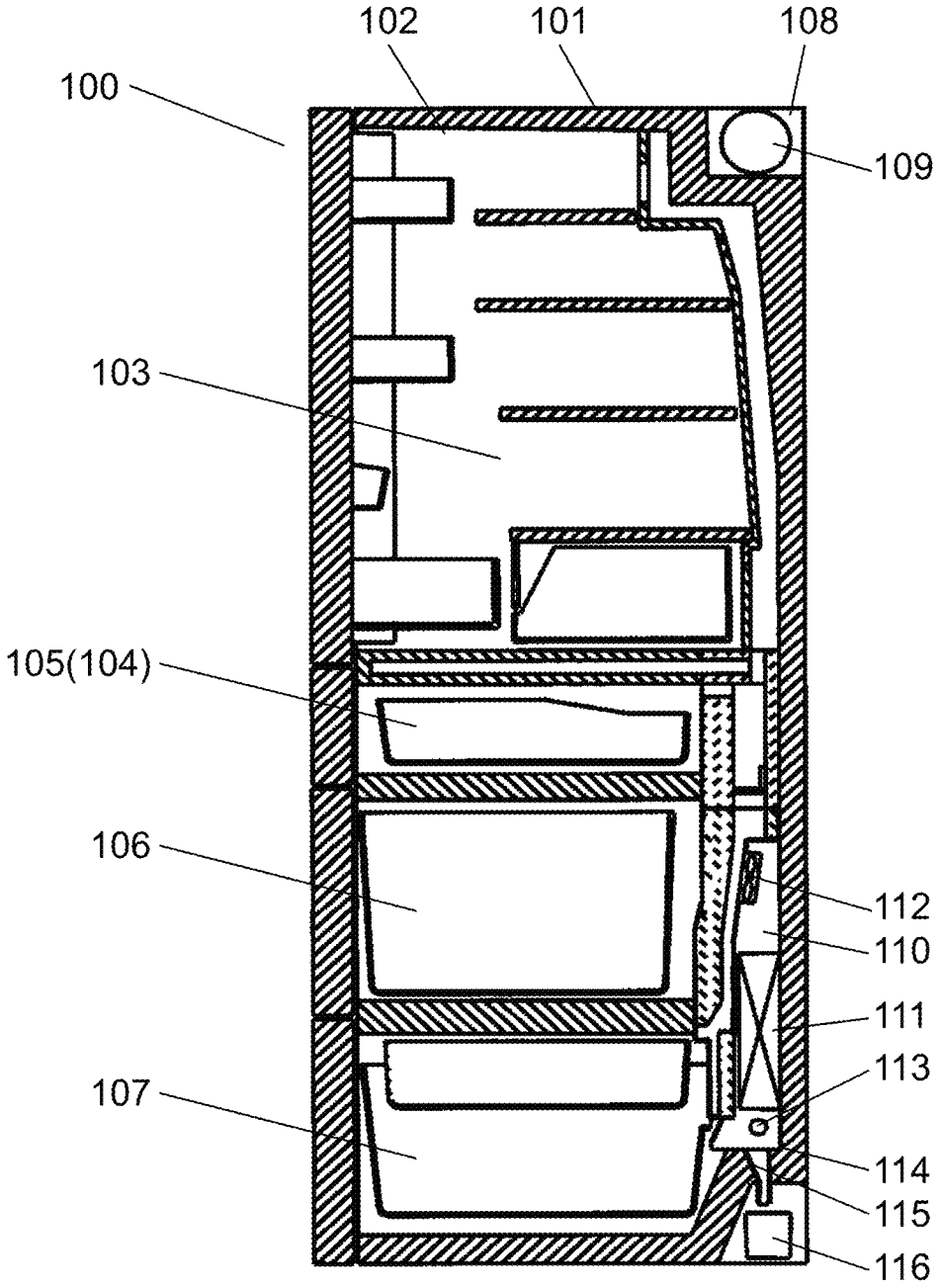
FIG. 1 is a diagram showing a vertical section of refrigerator 100.

FIG. 1 is a diagram showing a vertical section of refrigerator 100. A left side in FIG. 1 is a front side of refrigerator 100, and a right side in FIG. 1 is a rear side of the refrigerator. Refrigerator 100 is formed by outer box 101 mainly including a steel plate, inner box 102 molded with a resin such as acrylonitrile butadiene styrene (ABS), a heat insulating material (for example, hard urethane foam) filled in and foamed in a space between outer box 101 and inner box 102.

Refrigerator 100 includes a plurality of storage compartments. Refrigerating compartment 103 is provided at a top of refrigerator 100. Ice-making compartment 104 and thawing compartment 105 are provided below refrigerating compartment 103. Further, freezing compartment 106 is provided below ice-making compartment 104 and thawing compartment 105. Vegetable compartment 107 is provided at a bottom of refrigerator 100.

Refrigerating compartment 103 is maintained at a temperature that does not freeze for refrigerating storage, specifically, in a temperature range from 1° C. to 5° C. Vegetable compartment 107 is maintained at a temperature range from 2° C. to 7° C., which is equivalent to or slightly higher than a temperature in refrigerating compartment 103. Freezing compartment 106 is set in a freezing temperature range, specifically from −22° C. to −15° C., for frozen storage. Thawing compartment 105 is normally maintained in the same freezing temperature range as freezing compartment 106, and performs a heating treatment for thawing a stored object in response to a user's heating instruction. A structure of thawing compartment 105 and specific contents of the heat treatment will be described later in detail.

Machine compartment 108 is provided at an upper part of refrigerator 100. Machine compartment 108 accommodates components such as compressor 109 and a dryer that removes water, which configure a refrigeration cycle. Machine compartment 108 may be provided at a lower part of refrigerator 100.

Cooling compartment 110 is provided behind freezing compartment 106 and vegetable compartment 107. Cooling compartment 110 accommodates cooler 111 that generates cool air and cooling fan 112 that blows the cool air generated by cooler 111 to each storage compartment. Defrosting heater 113 that defrosts frost and ice adhering to cooler 111 and surroundings thereof is provided below cooling compartment 110. Drain pan 114, drain tube 115, and evaporating dish 116 are provided below defrosting heater 113.

Figure 2:
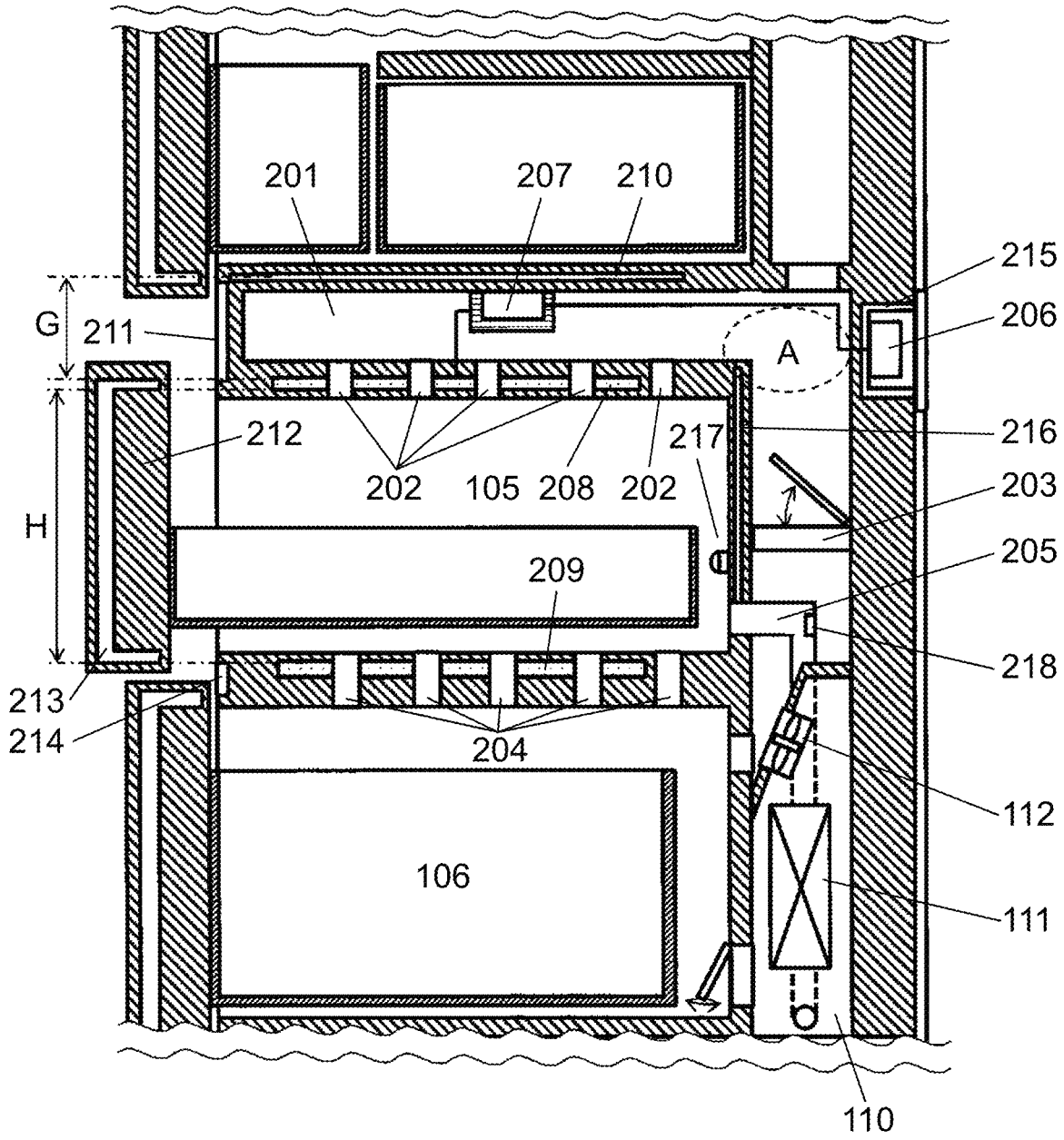
FIG. 2 is a diagram showing a configuration of thawing compartment 105.

Next, a configuration of thawing compartment 105 will be described with reference to FIG. 2. Thawing compartment 105 is normally maintained in the same freezing temperature range as freezing compartment 106, and freezes and stores food. The cool air generated by cooler 111 flows through air passage 201 provided on a rear surface and a top surface of thawing compartment 105, and is introduced into thawing compartment 105 through ventilation ports 202 provided on the top surface of thawing compartment 105. Damper 203 is provided in air passage 201. Further, ventilation ports 204 are also provided on a bottom surface of thawing compartment 105, and the cool air is introduced from freezing compartment 106 into thawing compartment 105 via ventilation ports 204. The cool air that has cooled thawing compartment 105 returns to cooling compartment 110 through suction port 205.

Next, a mechanism of heating and thawing the stored object kept frozen in thawing compartment 105 will be described. Refrigerator 100 includes oscillator 206, matching unit 207, oscillation electrode 208, and counter electrode 209. Oscillator 206 is embedded in the heat insulating material on the rear side of refrigerator 100. Matching unit 207 adjusts a load impedance formed by oscillation electrode 208, counter electrode 209, and the stored object to be close to an output impedance of oscillator 206. Matching unit 207 is provided in air passage 201 and is covered with the heat insulating material. Oscillation electrode 208 is embedded in a heat insulating partition wall that configures the top surface of thawing compartment 105. Counter electrode 209 is embedded in a heat insulating partition wall configuring the bottom surface of thawing compartment 105. Matching unit 207 is connected to oscillation electrode 208. Oscillator 206 is connected to matching unit 207. A length of wiring connecting oscillator 206, matching unit 207, and oscillation electrode 208 is desirably as short as possible, and thus these are concentrated near thawing compartment 105. Oscillator 206 outputs a high frequency wave in the VHF band (40 MHz in the present exemplary embodiment). Then, an electric field is formed between oscillation electrode 208 and counter electrode 209. As a result, the stored object placed between oscillation electrode 208 and counter electrode 209 is heated.

Refrigerator 100 is provided with an electromagnetic wave shield that prevents electromagnetic waves from leaking to outside. Electromagnetic wave shield 210 is embedded in above air passage 201 (in other words, a partition that separates thawing compartment 105 and refrigerating compartment 103). An electromagnetic wave shield 213 is embedded inside door 212 that opens and closes thawing compartment 105. Electromagnetic wave shield 213 is covered with the heat insulating material. Electromagnetic wave shield 211 and electromagnetic wave shield 214 are embedded in a housing part of refrigerator 100 which is in contact with door 212 while door 212 is closed. Electromagnetic wave shield 215 is provided on a wall surface of a space that accommodates oscillator 206. Further, electromagnetic wave shield 216 is provided on a wall surface of the rear side of thawing compartment 105. When a steel plate is used as an exterior material of a housing of refrigerator 100, the steel plate itself has a role of an electromagnetic wave shield.

Electromagnetic wave shield 213 provided inside door 212 will be described in more detail. When wiring runs between electromagnetic wave shield 213 and a grounding part of refrigerator 100, because the user opens and closes door 212, the wiring is repeatedly bent and extended and metal fatigue accumulates as door 212 is opened and closed. This causes a disconnection of the wiring, which is not preferable to ground electromagnetic wave shield 213 with the wiring. Therefore, in the present exemplary embodiment, a distance between electromagnetic wave shield 213 and electromagnetic wave shield 211 when door 212 is closed, and a distance between electromagnetic wave shield 213 and electromagnetic wave shield 214 when door 212 is closed are set shorter than one quarter of a wavelength of each electromagnetic wave. For example, the distance between electromagnetic wave shield 213 and electromagnetic wave shield 211 when door 212 is closed and the distance between electromagnetic wave shield 213 and electromagnetic wave shield 214 when door 212 is closed are within 30 mm. Electromagnetic wave shield 211 and electromagnetic wave shield 214 are grounded, and thus, by bringing electromagnetic wave shield 213 close to electromagnetic wave shield 211 and electromagnetic wave shield 214 while door 212 is closed, an effect equal to that of grounding by wiring can be obtained. Further, an end of electromagnetic wave shield 213 is bent inside refrigerator 100, and thus electromagnetic wave shield 213 can be easily brought close to electromagnetic wave shield 211 and electromagnetic wave shield 214. Electromagnetic wave shield 216 is provided on a wall surface of the rear side of thawing compartment 105. This aims to prevent the electric field generated between oscillation electrode 208 and counter electrode 209 and a high frequency noise generated from matching unit 207 from affecting electric components such as cooling fan 112 and damper 203.

Electromagnetic wave shield 210 may be provided inside refrigerating compartment 103 located above thawing compartment 105. Refrigerating compartment 103 is often provided with a partial freezing compartment or a chilling compartment, and a top surface of the partial freezing compartment or the chilling compartment may be used as an electromagnetic wave shield.

Air passage 201 has a shape that bends at a substantially right angle. A distance between area A corresponding to this bent part and matching unit 207, and a width of air passage 201 are set shorter than one quarter of the wavelength of the electromagnetic wave, and thus the high frequency noise generated from matching unit 207 cannot curve at area A. For example, the distance between area A and matching unit 207 is within 30 mm.

When the user opens and closes door 212, high-humidity air flows into thawing compartment 105 in the freezing temperature range, and dew condensation easily occurs inside thawing compartment 105. When oscillation electrode 208 and counter electrode 209 are exposed inside thawing compartment 105, dew condensation occurs on surfaces of oscillation electrode 208 and counter electrode 209, making a formation of the electric field unstable. As a result, a case may occur in which a heating action is not sufficiently obtained or not obtained at all. On the other hand, in the present exemplary embodiment, both oscillation electrode 208 and counter electrode 209 are embedded in the partition wall configuring thawing compartment 105. This can prevent dew condensation from occurring on the surfaces of oscillation electrode 208 and counter electrode 209.

Further, oscillator 206 and matching unit 207 are not installed inside thawing compartment 105, and thus dew condensation can be prevented from occurring on oscillation unit 206 and matching unit 207. Particularly, in the present exemplary embodiment, matching unit 207 is installed in air passage 201. The cool air with low humidity flowing through air passage 201 can prevent dew condensation from occurring on matching unit 207. Further, oscillator 206 is embedded in the heat insulating material on the rear side of refrigerator 100 and is independent of thawing compartment 105, and thus dew condensation is prevented from occurring on oscillator 206. Both oscillator 206 and matching unit 207 may be installed in air passage 201, or both oscillator 206 and matching unit 207 may be embedded in the heat insulating material on the rear side of refrigerator 100.

Figure 3A:
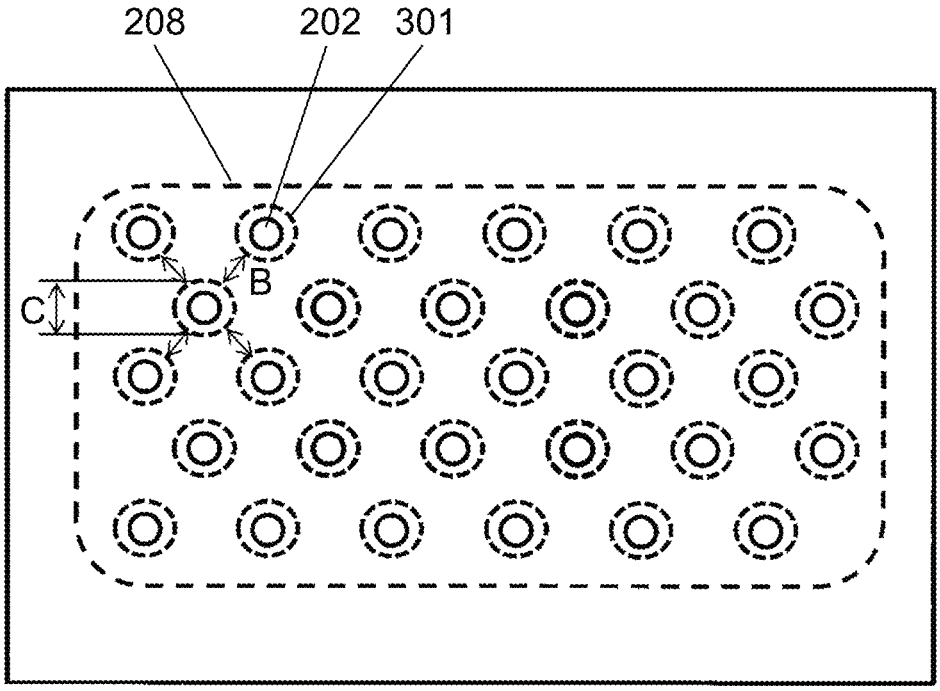
FIG. 3A is a diagram showing a positional relationship between an electrode and ventilation ports.

Next, a positional relationship between oscillation electrode 208 and ventilation ports 202 will be described with reference to FIG. 3A. FIG. 3A is a sketch of the top surface of thawing compartment 105. A plurality of electrode holes 301 is provided in oscillation electrode 208, and ventilation ports 202 are provided inside electrode holes 301. The plurality of electrode holes 301 is arranged at equal intervals (distance B). If oscillation electrode 208 is not provided with the plurality of electrode holes 301, an electric field is strongly formed only on an outer periphery of oscillation electrode 208, and the stored object cannot be heated uniformly. By providing the plurality of electrode holes 301 in oscillation electrode 208, a creeping surface is formed not only on the outer periphery of oscillation electrode 208 but entirely on oscillation electrode 208. As a result, parts where the electric field is strongly formed are made uniform, and the stored object can be favorably heated and thawed. Further, ventilation ports 202 are provided inside electrode holes 301, and thus the area of the electrode can be increased as compared with a case where electrode holes 301 and ventilation holes 202 are provided at different positions. Further, hole diameter C of electrode holes 301 is desirably larger than the distance B. If hole diameter C is smaller than distance B, potential of oscillation electrode 208 is not uniform, which makes it difficult to uniformly heat the stored object.

Figure 3B:
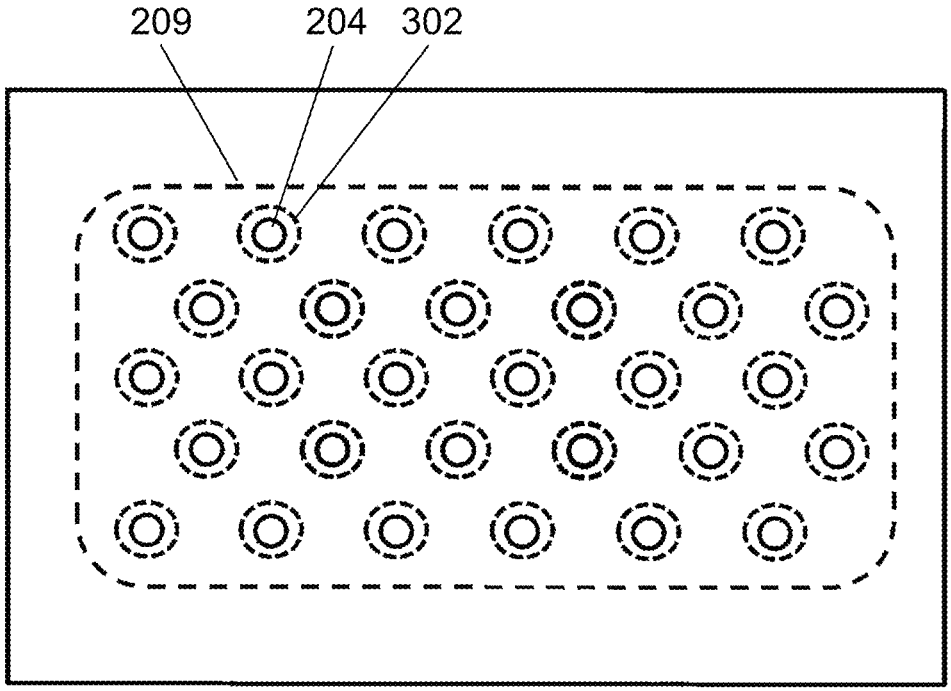
FIG. 3B is a diagram showing a positional relationship between an electrode and ventilation ports.

FIG. 3B is a sketch of the bottom surface of thawing compartment 105. A plurality of electrode holes 302 is provided in counter electrode 209, and ventilation ports 204 are provided inside electrode holes 301. Electrode holes 302 and ventilation ports 204 are provided at positions respectively facing electrode holes 301 and ventilation ports 202.

Figure 4:
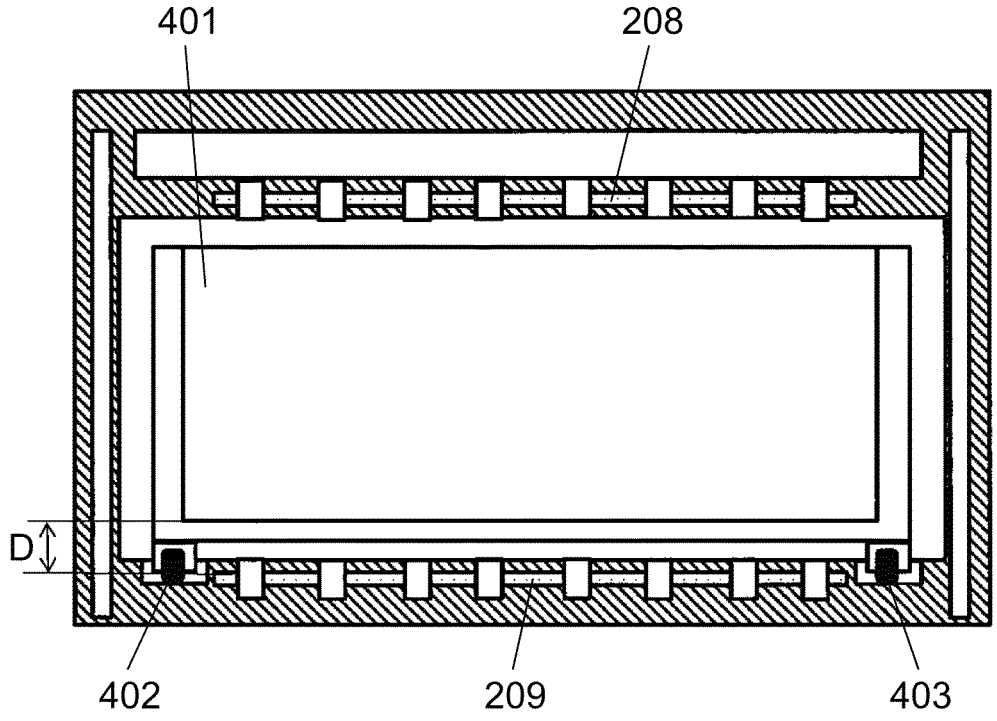
FIG. 4 is a view showing a cross section when thawing compartment 105 is viewed from a front face of refrigerator 100.

Next, with reference to FIG. 4, a sectional view of thawing compartment 105 as viewed from a front face of refrigerator 100 will be described. A thawing compartment case 401 is provided in thawing compartment 105. Rail part 402 and rail part 403 are provided on the bottom surface of thawing compartment 105. Door 212 and thawing compartment case 401 are structured to move in a front and rear direction when pulled out by the user. Distance D between a bottom surface of thawing compartment case 401 and counter electrode 209 is preferably less than or equal to 10 mm such that the electromagnetic waves are efficiently absorbed by the stored object.

Figure 5A:
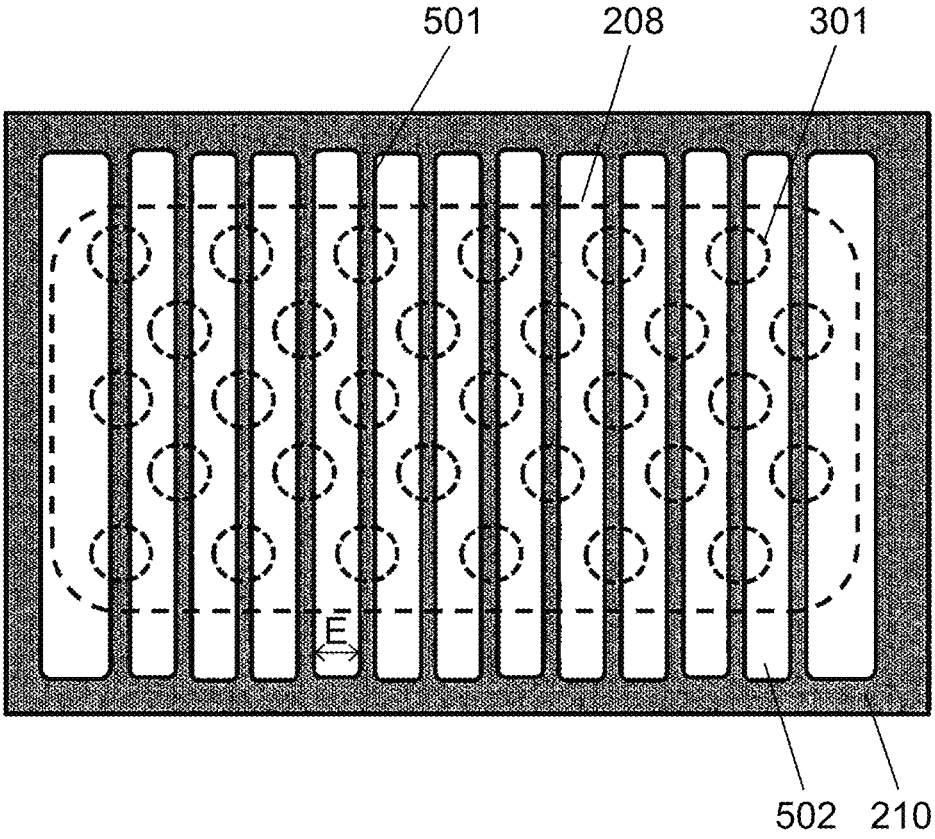
FIG. 5A is a diagram showing a positional relationship between electromagnetic wave shield 210 and electrode holes 301.

Next, electromagnetic wave shield 210 and a positional relationship between electromagnetic wave shield 210 and electrode hole 301 will be described with reference to FIGS. 5A and 5B. FIG. 5A is a sketch of electromagnetic wave shield 210 as viewed from above. Electromagnetic wave shield 210 is a thin plate including a metal or a conductive material such as a conductive resin, and is grounded. Electromagnetic wave shield 210 has a mesh structure having comb-shaped parts 501 at positions overlapping electrode holes 301. Width dimension E of shield holes 502 sandwiched between adjacent comb-shaped parts 501 is desirably smaller than one quarter of the wavelength of the electromagnetic wave. Making width dimension E smaller than one quarter of the wavelength of the electromagnetic wave makes it difficult for the electromagnetic wave to leak to outside through shield holes 502. In the present exemplary embodiment, the width dimension E is set to, for example, within 30 mm.

Figure 5B:
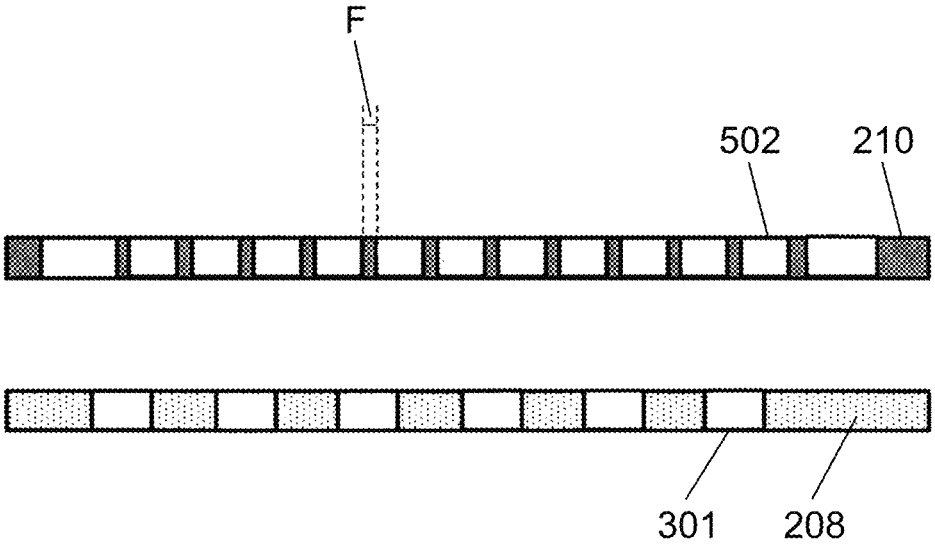
FIG. 5B is a diagram showing a positional relationship between electromagnetic wave shield 210 and electrode holes 301.

FIG. 5B is a diagram showing a positional relationship between electromagnetic wave shield 210 and oscillation electrode 208 as viewed from the front face of refrigerator 100. Width dimension F of comb-shaped parts 501 is desirably smaller than hole diameter C of electrode holes 301. If width dimension F of comb-shaped parts 501 is larger than hole diameter C of electrode holes 301, an area where oscillation electrode 208 and electromagnetic wave shield 210 face each other remarkably increases. When the distance between oscillation electrode 208 and electromagnetic wave shield 210 (distance G in FIG. 2) is smaller than the distance between oscillation electrode 208 and counter electrode 209 (distance H in FIG. 2) as in a case of refrigerator 100, an electric field is also generated between oscillation electrode 208 and electromagnetic wave shield 210. The electric field generated between oscillation electrode 208 and electromagnetic wave shield 210 does not contribute to the heating of the stored object, and energy loss occurs from a viewpoint of heating the stored object. A degree of this energy loss increases as the area where oscillation electrode 208 and electromagnetic wave shield 210 face each other increases. Therefore, for example, by making width dimension F of comb-shaped parts 501 smaller than hole diameter C of electrode holes 301, the area where oscillation electrode 208 and electromagnetic wave shield 210 face each other is reduced, and the degree of energy loss is reduced.

Further, when electromagnetic wave shield 210 has a flat plate-like structure without holes, the area where oscillation electrode 208 and electromagnetic wave shield 210 face each other becomes larger than when electromagnetic wave shield 210 has a mesh structure. This increases the degree of energy loss described above. Thus, making electromagnetic wave shield 210 into a mesh structure leads to reducing the degree of energy loss.

Shapes of electrode holes 301 and electrode holes 302 are not limited to a circle, but may be a rectangle or an ellipse. In this case, the shapes of ventilation port 202 and ventilation port 204 also need to match the shapes of electrode holes 301 and 302, respectively.

Figure 6:
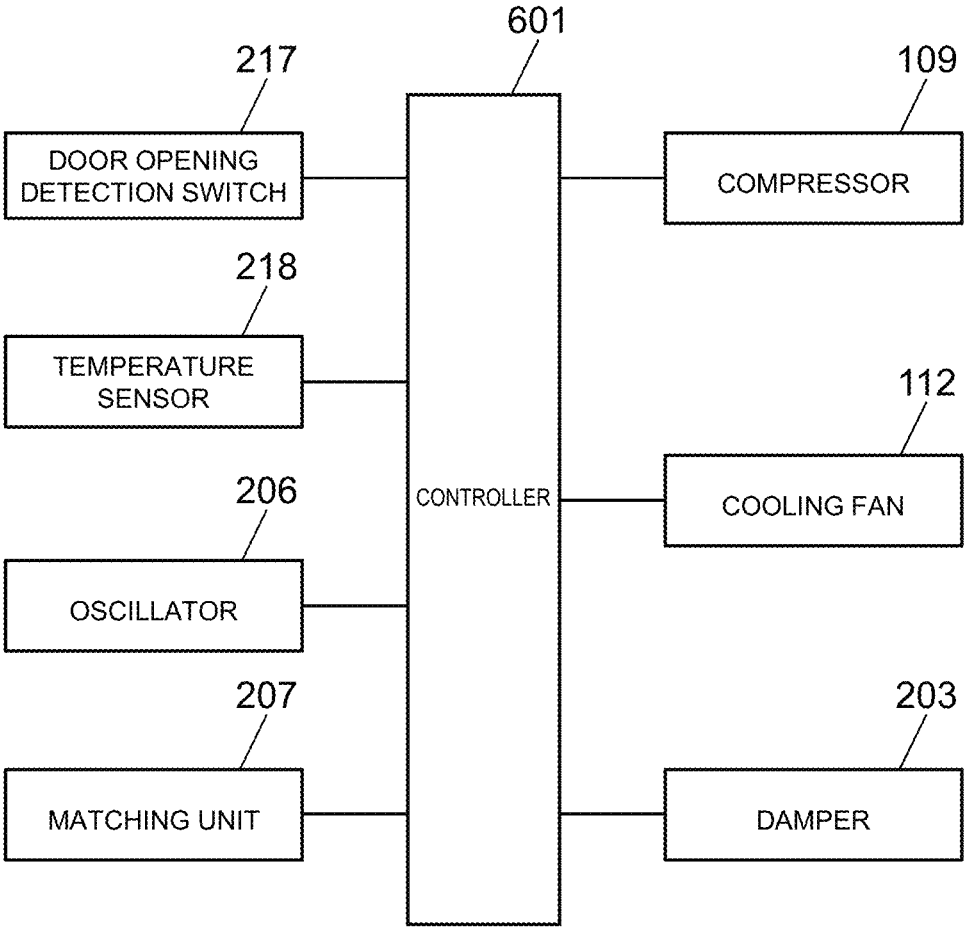
FIG. 6 is a diagram showing a hardware configuration of refrigerator 100.

Next, FIG. 6 is a schematic diagram of a hardware configuration of refrigerator 100. Controller 601 is a control board including a central processing unit (CPU), a read only memory (ROM), and a random access memory (RAM), and is disposed on the top surface or the rear surface of refrigerator 100. The CPU reads a control program stored in the ROM and executes various processes for controlling an operation of refrigerator 100. The ROM stores the control program. The RAM is used as a temporary storage region. Controller 601 controls operations of each unit of refrigerator 100 such as compressor 109, cooling fan 112, damper 203, oscillator 206, matching unit 207, door opening detection switch 217, and temperature sensor 218.

Door opening detection switch 217 is a switch that detects whether door 212 is open or closed. Door opening detection switch 217 is a push-in switch, and when door opening detection switch 217 is pushed in, door opening detection switch 217 outputs to controller 601 that the door 212 is closed. On the other hand, when door opening detection switch 217 is not pushed in, door opening detection switch 217 outputs to controller 601 that door 212 is open. Temperature sensor 218 detects a temperature of thawing compartment 105. Door opening detection switch 217 and temperature sensor 218 are provided at positions shown in FIG. 2.

Figure 7:
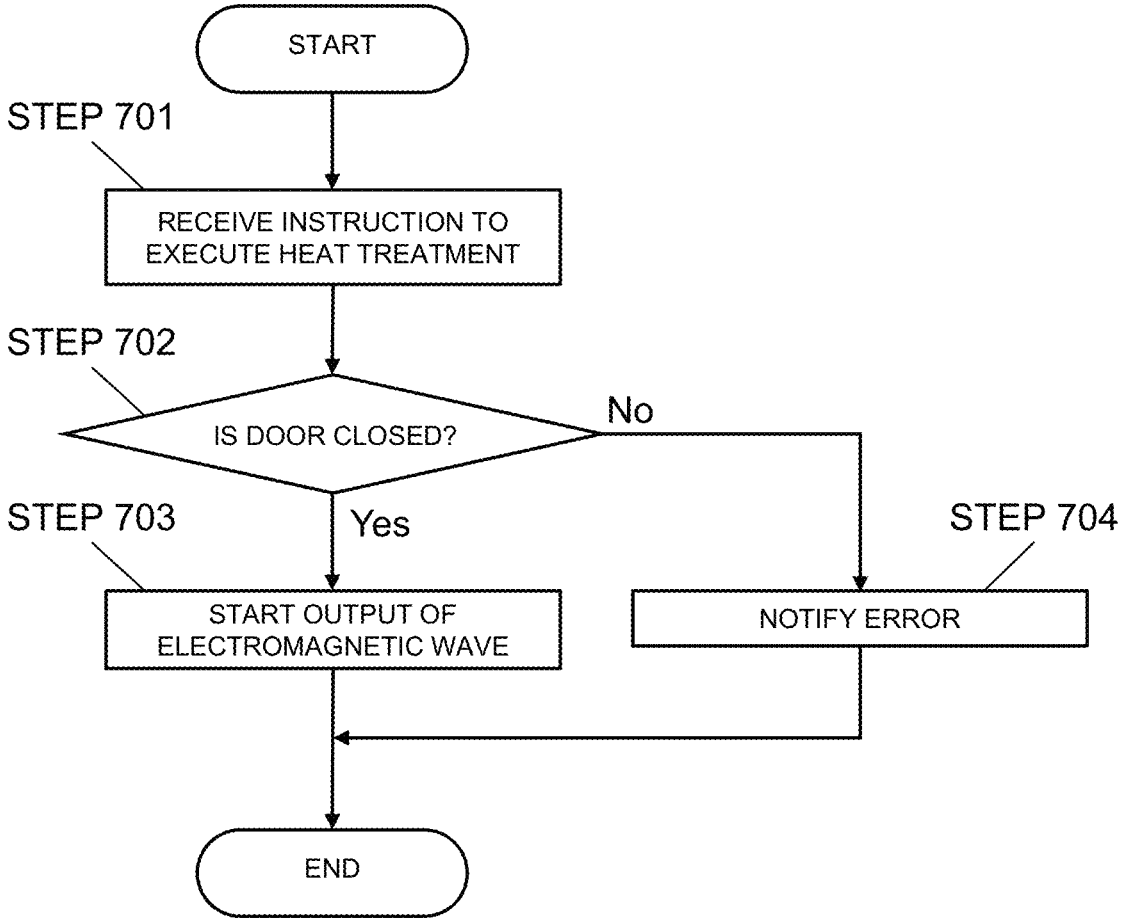
FIG. 7 is a flowchart showing a process executed by refrigerator 100.

Next, the process executed by refrigerator 100 when refrigerator 100 receives an instruction to execute the heat treatment from the user will be described with reference to a flowchart in FIG. 7. Each step shown in the flowchart in FIG. 7 is achieved by the CPU of controller 601 executing the control program stored in the memory such as a ROM.

First, in step 701, controller 601 receives the instruction to execute the heat treatment from the user. The execution instruction is input to refrigerator 100 in one of the following three patterns.

(Pattern 1) Refrigerator 100 includes an operation unit (not shown). The user operates this operation unit to input the execution instruction to refrigerator 100.

(Pattern 2) Refrigerator 100 includes a wireless communication unit (not shown), and this wireless communication unit is connected to a wireless LAN network. When the user inputs a heating instruction to an external terminal such as a smartphone, the wireless communication unit receives the execution instruction via the wireless LAN network, and the execution instruction is input to refrigerator 100.

(Pattern 3) Refrigerator 100 includes a voice recognition unit (not shown), and the user inputs the execution instruction to refrigerator 100 by voice.

Next, in step 702, controller 601 determines whether door 212 is closed. Controller 601 determines whether door 212 is closed based on an output result of door opening detection switch 217. When door 212 is closed, the processing proceeds to step 703. On the other hand, when the door is open, the processing proceeds to step 704.

Next, step 703 will be described. In step 703, controller 601 starts outputting electromagnetic waves in order to heat the stored object in thawing compartment 105. Oscillator 206 outputs electromagnetic waves under control of controller 601, and thus an electric field is formed between oscillation electrode 208 and counter electrode 209, and heating of a storage unit is started.

Next, step 704 will be described. In step 704, controller 601 notifies an error without starting the output of the electromagnetic waves. There is a risk that electromagnetic waves may leak outside refrigerator 100 because door 212 is open. Thus, in step 704, the output of the electromagnetic waves is not started to prevent the electromagnetic waves from leaking out of refrigerator 100. The error notification executed by controller 601 refers to displaying a message such as "The door is open. Please close the door and try again" on a display unit (not shown) of refrigerator 100 or outputting a similar message by voice. With such a notification of error, controller 601 prompts the user to close door 212.

Figure 8:
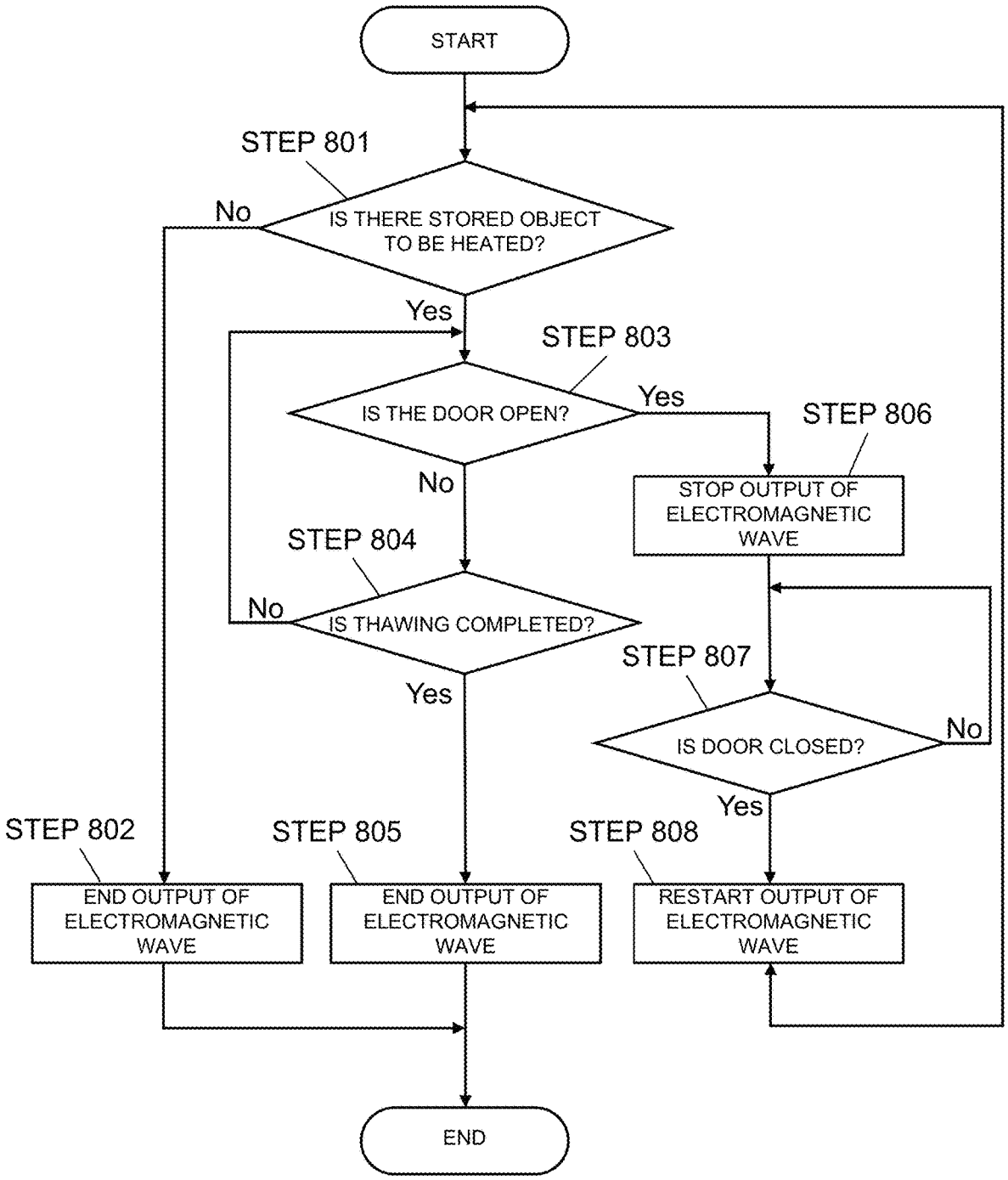
FIG. 8 is a flowchart showing a process executed by refrigerator 100.

Next, the process executed by refrigerator 100 after starting the output of electromagnetic waves will be described with reference to the flowchart in FIG. 8. Each step shown in the flowchart in FIG. 8 is achieved by the CPU of controller 601 executing the control program stored in the memory such as the ROM.

First, in step 801, controller 601 determines whether there is a stored object to be heated. Controller 601 operates matching unit 207 to execute a matching process for minimizing a reflected wave of the electromagnetic wave. When a ratio of the reflected wave to the output electromagnetic wave (hereinafter this ratio is called reflectance) exceeds threshold value R1 immediately after the matching process is completed, controller 601 determines that there is no stored object to be heated in thawing compartment case 401, and the processing proceeds to step 802. On the other hand, when the reflectance immediately after the completion of the matching process does not exceed predetermined value R1, controller 601 determines that there is a stored object to be heated in thawing compartment case 401, and the processing proceeds to step 803.

Next, step 802 will be described. In step 802, controller 601 ends the output of the electromagnetic waves. At this time, controller 601 may display a message such as "The food is not stored in the thawing compartment, and thawing is completed" on the display unit (not shown) of refrigerator 100, or output a similar message by voice.

Next, step 803 will be described. In step 803, controller 601 determines whether door 212 is open. When door 212 is not open, that is, when door 212 remains closed, the processing proceeds to step 804. On the other hand, when door 212 is open, the processing proceeds to step 806.

Next, step 806 will be described. In step 806, controller 601 stops the output of the electromagnetic waves. When the electromagnetic waves are continuously output with door 212 open, the electromagnetic waves may leak to the outside of refrigerator 100. Thus, in step 806, the output of the electromagnetic waves is stopped to prevent the electromagnetic waves from leaking out of refrigerator 100. At this time, controller 601 may display a message such as "Thawing is stopped. Please close the door to restart thawing" on the display unit (not shown) of refrigerator 100, or may output a similar message by voice.

Next, in step 807, controller 601 determines whether door 212 is closed. When door 212 is closed, the processing proceeds to step 808. On the other hand, when door 212 is not closed, that is, when door 212 remains open, controller 601 stands by until door 212 is closed.

Next, in step 808, controller 601 restarts the output of the electromagnetic waves. When the output of electromagnetic waves is restarted, the process returns to step 801.

Next, step 804 will be described. In step 804, controller 601 determines whether thawing of the stored object is completed. When the thawing of the stored object is completed, the processing proceeds to step 805. On the other hand, when the thawing of the stored object is not completed, the process returns to step 803. Conditions for determining that the thawing of the stored object is completed will be described later in detail.

Next, in step 805, controller 601 ends the output of the electromagnetic waves. At this time, controller 601 may display a message such as "Thawing is completed" on the display unit (not shown) of refrigerator 100, or may output a similar message by voice.

Note that a temperature of the stored object rises from the start to the end of the output of the electromagnetic waves. The rise in the temperature of the stored object leads to the rise in the temperature of thawing compartment 105. Thus, the temperature of thawing compartment 105 is desirably maintained in the freezing temperature range by controlling opening and closing operations of damper 203 while oscillator 206 outputs the electromagnetic waves. Further, the user does not always take out the stored object immediately after thawing of the stored object is completed. By maintaining the temperature of thawing compartment 105 in the freezing temperature range while oscillator 206 outputs the electromagnetic waves, the stored object is immediately frozen to maintain freshness of the stored object when the user does not immediately take out the stored object.

Figures 9, 10:
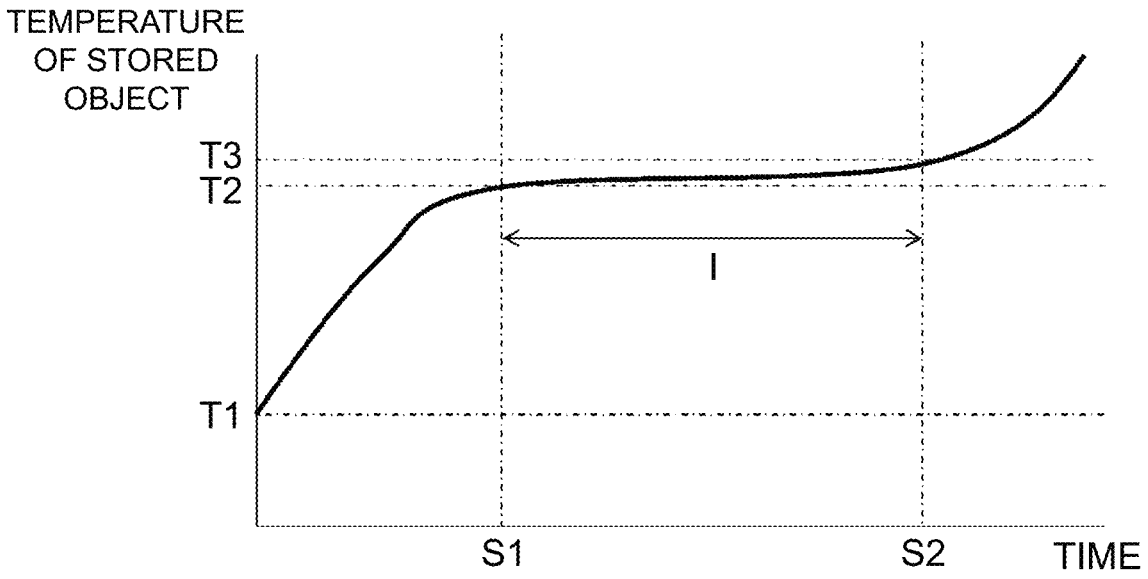
FIG. 9 is a graph showing changes in temperature of a stored object when the stored object is heated.
FIG. 10 is a diagram showing evaluation results of ease of cutting and a drip amount.

Next, the conditions for determining that the thawing of the stored object is completed will be described with reference to FIGS. 9, 10, and 11. FIG. 9 is a graph showing changes in temperature of the stored object that is kept frozen when the stored object is heated. A vertical axis of the graph shows the temperature of the stored object, and a horizontal axis of the graph shows a passage of time. Temperature T1 indicates the temperature of the stored object that is kept frozen. As the heat treatment progresses, the temperature of the stored objects rises to T2, and the stored object starts to melt. This timing is referred to as time S1. When the stored object continues to be heated, thawing of the stored object is completed at time S2. The temperature of the stored object at this time is referred to as T3.

As described above, the thawing of the stored object starts at time S1 and is completed at time S2. Assuming that a melting rate at time S1 is 0% and a melting rate at time S2 is 100%, ease of cutting with a kitchen knife and a drip amount are evaluated at five stages of the melting rate of 20%, 40%, 60%, 80%, and 100%. Results of this evaluation are shown in FIG. 10. As a result of the evaluation, when the melting rate is 60%, a female can cut with one hand, and the drip amount is very small. It is therefore desirable to determine that the melting rate of 60% is the best melting state, and timing when the melting rate reaches 60% is timing when the thawing is completed. However, as is clear from the graph in FIG. 9, the temperature change during a period when the melting of the stored object is advancing (period I in FIG. 9) is small. It is therefore difficult to specify the timing when the melting rate reaches 60% based on the temperature change of the stored object. Accordingly, in the present exemplary embodiment, the timing immediately after the melting rate of the stored object reaches 60% is specified by using the reflectance immediately after the matching process by matching unit 207 is completed.

Figure 11:
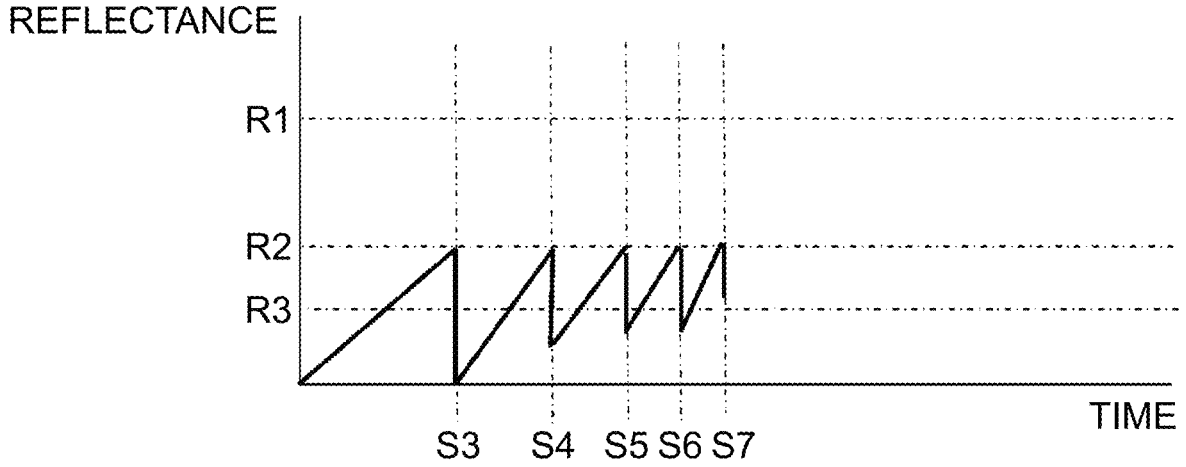
FIG. 11 is a graph showing changes in reflectance.

FIG. 11 is a graph showing changes in the reflectance. The vertical axis of the graph indicates a magnitude of reflectance, and a horizontal axis of the graph indicates a passage of time. As the melting of the stored object advances, a number of melted water molecules in the stored object increases. Then, a matching state of the impedance shifts and the reflectance increases as the number of melted water molecules in the stored object increases. When the reflectance reaches threshold value R2, matching unit 207 matches the impedance again, and the reflectance decreases. This timing corresponds to time S3, S4, S5, S6, and S7 in the graph in FIG. 11. In the present exemplary embodiment, the timing when the reflectance immediately after the matching process by matching unit 207 exceeds threshold value R3 is specified as the timing when the melting rate of the stored object reaches 60%. This timing corresponds to S7 in the graph in FIG. 11. That is, in the present exemplary embodiment, the timing when the reflectance immediately after the matching process by matching unit 207 exceeds threshold value R3 is timing when controller 601 determines that the thawing of the stored object is completed in step 804 in FIG. 8. Threshold value R3 corresponding to the melting rate of 60% is a value obtained in advance by experiments. By focusing on the ratio of the reflected wave to the output electromagnetic wave, it can be specified that the melting of the stored object has reached a desired state (the melting rate of 60% in the present exemplary embodiment) even during a period in which the temperature change is small. It has been described that the timing when the melting rate reaches 60% is determined as the timing when the thawing is completed in the present exemplary embodiment. However, another value may be adopted as a target melting rate.

As described above, according to the present exemplary embodiment, electromagnetic wave shield 213 of door 212 in which wiring to the grounding part is difficult can sufficiently exhibit the function as an electromagnetic wave shield. Further, refrigerator 100 does not output the electromagnetic waves while door 212 is open, and it is therefore possible to prevent the electromagnetic waves from leaking out of refrigerator 100 due to door 212 being open.

Second Exemplary Embodiment

When door 212 is opened, high-humidity air flows into thawing compartment 105 from the outside of refrigerator 100. Then, when the heat treatment is started immediately after door 212 is closed, water vapor is generated from the stored object as the thawing of the stored object advances, and dew condensation easily occurs inside thawing compartment 105. The present exemplary embodiment therefore aims to reduce a possibility of dew condensation occurring inside thawing compartment 105 by not starting the heat treatment immediately after door 212 is closed.

Figure 12:
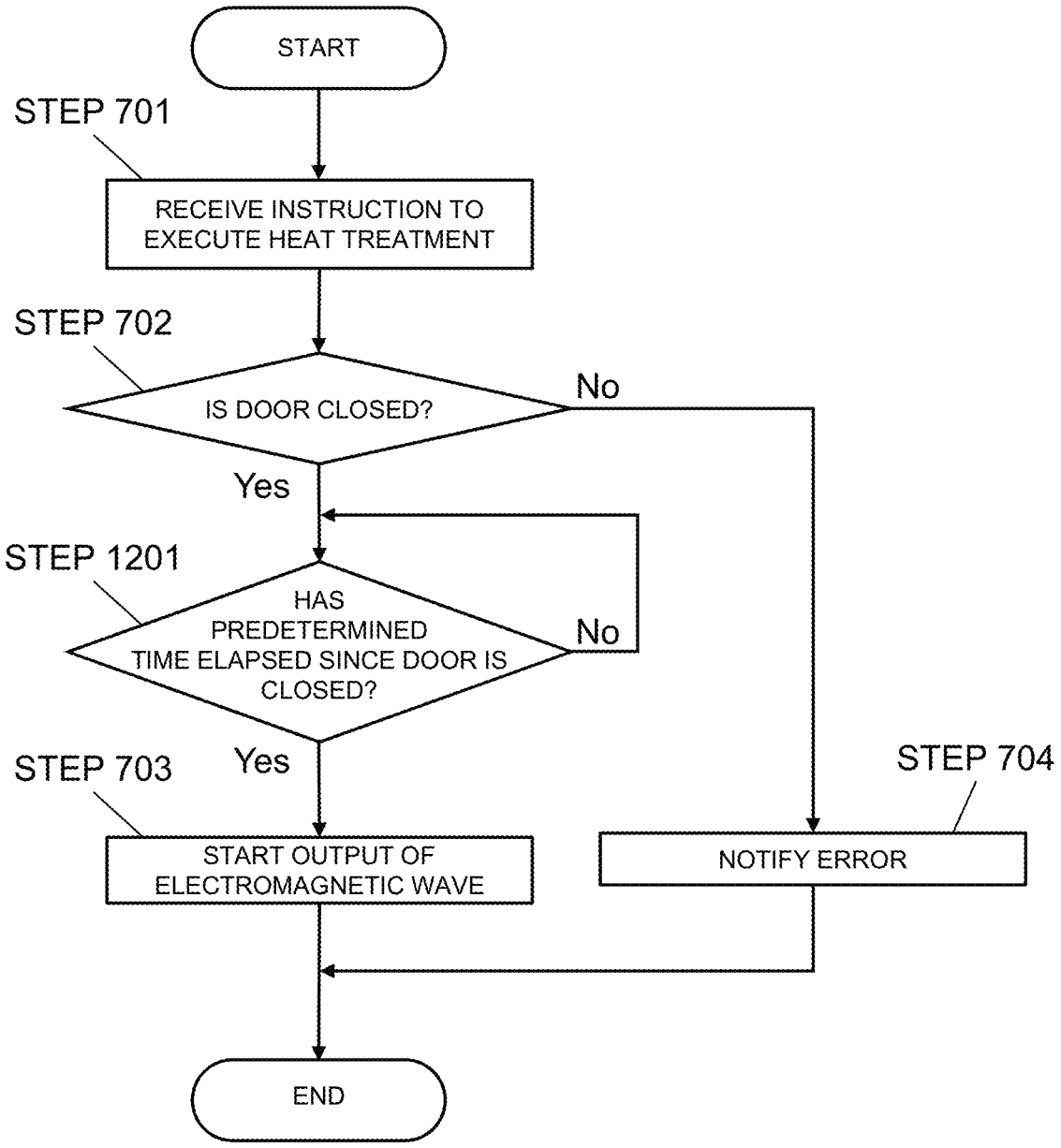
FIG. 12 is a flowchart showing a process executed by refrigerator 100.

FIG. 12 is a flowchart showing a process executed by refrigerator 100 when refrigerator 100 receives the instruction to execute the heat treatment from the user. Of the steps in the flowchart in FIG. 12, steps having the same numbers as those in the flowchart in FIG. 7 are the same processes as those in the flowchart in FIG. 7 and description thereof will not be repeated.

When controller 601 determines in step 702 that door 212 is closed, the processing proceeds to step 1201. Then, in step 1201, controller 601 determines whether a predetermined time (for example, 1 minute) has elapsed since door 212 is closed. Refrigerator 100 has a clocking function such as a real time clock (RTC), and measures elapsed time after door 212 is closed. When the predetermined time has not elapsed since door 212 is closed, controller 601 stands by until the predetermined time has elapsed.

Figure 13:
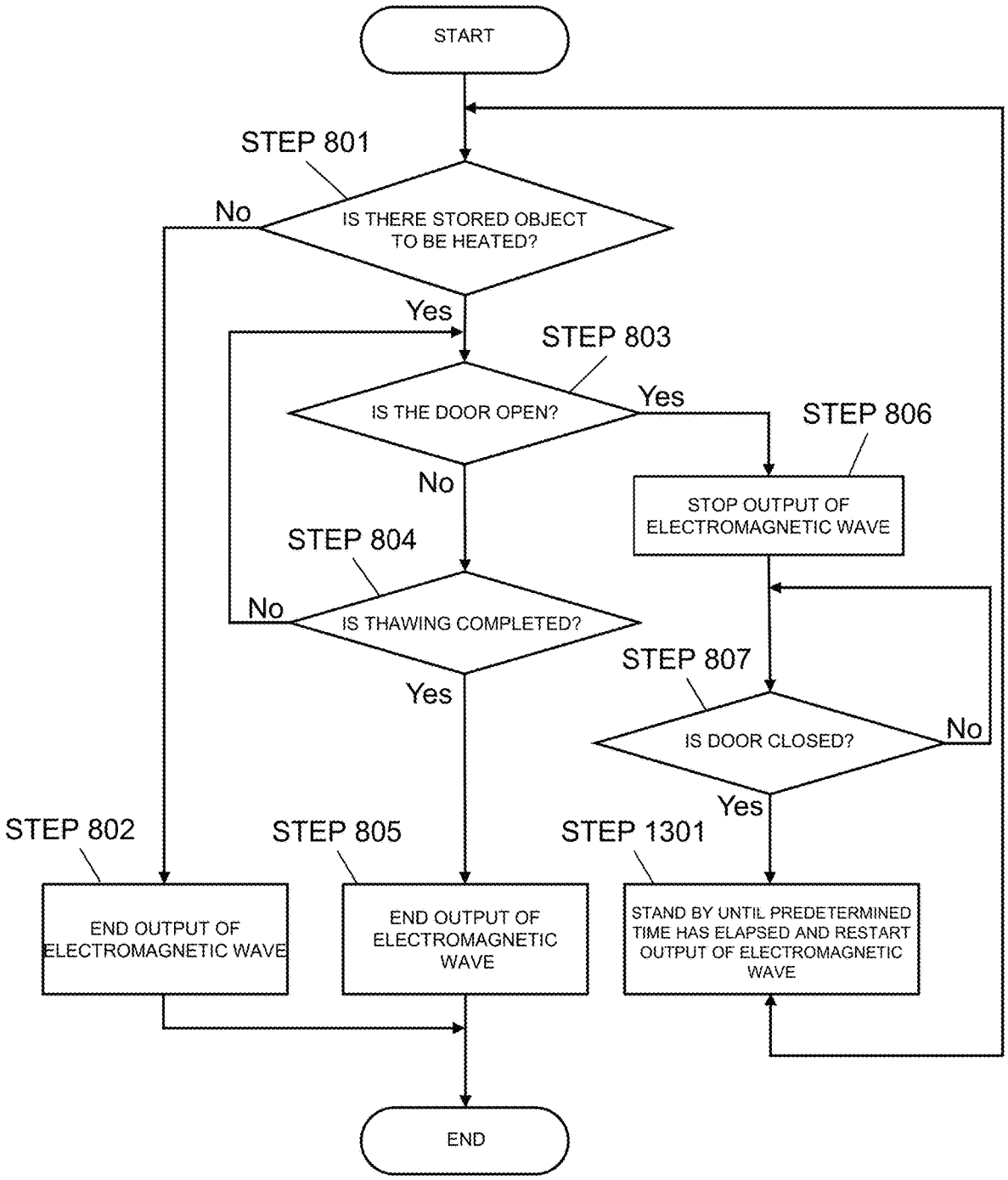
FIG. 13 is a flowchart showing a process executed by refrigerator 100.

FIG. 13 is a flowchart showing a process executed by refrigerator 100 after starting the output of the electromagnetic waves. Of the steps in the flowchart in FIG. 13, steps having the same numbers as those in the flowchart of FIG. 8 are the same processes as those in the flowchart in FIG. 8 and description thereof will not be repeated.

When controller 601 determines in step 807 that door 212 is closed, the processing proceeds to step 1301. Next, in step 1301, controller 601 stands by until a predetermined time (for example, 1 minute) has elapsed and restarts the output of the electromagnetic waves.

That is, in refrigerator 100 of the present exemplary embodiment, the heat treatment is not started until the predetermined time elapses after door 212 is closed. The cool air flowing through air passage 201 has low humidity, and thus refrigerator 100 can lower the humidity of thawing compartment 105 by standing by for a predetermined time and can start the heat treatment after lowering the humidity of thawing compartment 105. This can reduce the possibility that dew condensation occurs inside thawing compartment 105.

Third Exemplary Embodiment

When defrosting is performed by defrosting heater 113, a large amount of water vapor flows from cooling compartment 110 into thawing compartment 105. When the heat treatment is started in this state, water vapor is generated from the stored object as the thawing of the stored object advances, and dew condensation easily occurs inside thawing compartment 105. Thus, in the present exemplary embodiment, damper 203 is closed while the defrosting by defrosting heater 113 is being performed. That is, in the present exemplary embodiment, by preventing the water vapor generated by defrosting from flowing into thawing compartment 105, it is possible to reduce the possibility that dew condensation occurs inside thawing compartment 105.

Fourth Exemplary Embodiment

Figure 14:
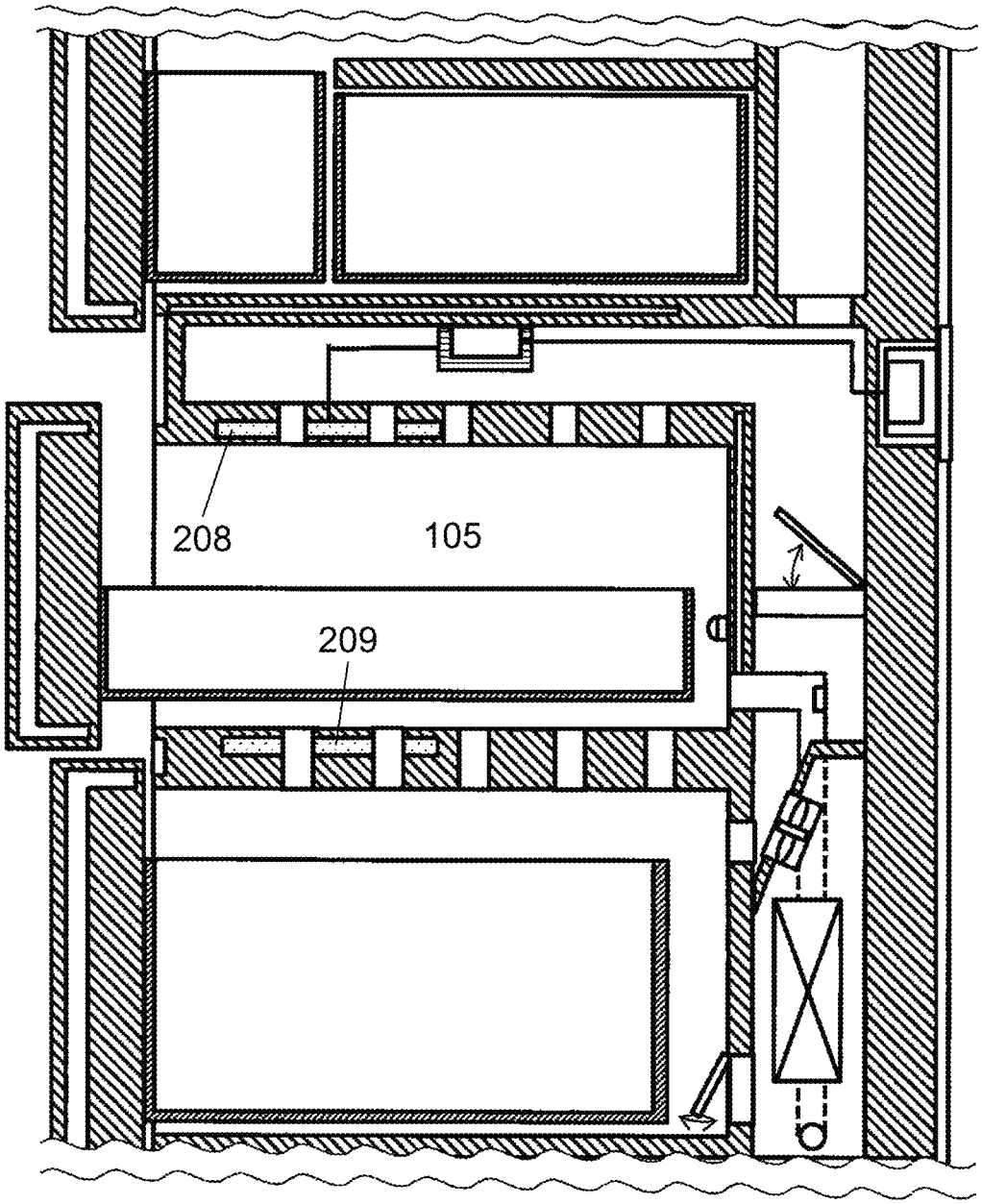
FIG. 14 is a diagram showing a modified example of thawing compartment 105.

In the present exemplary embodiment, a modified example of thawing compartment 105 will be described. In each of the above exemplary embodiments, an example has been described in which oscillation electrode 208 is embedded in the entire top surface of thawing compartment 105 and counter electrode 209 is embedded in the entire bottom surface of thawing compartment 105. However, a region where oscillation electrode 208 and counter electrode 209 are embedded can be changed as appropriate. For example, as shown in FIG. 14, oscillation electrode 208 and counter electrode 209 may be embedded on the front side as viewed from the front face of refrigerator 100, and the rear side of refrigerator 100 may be a region where oscillation electrode 208 and counter electrode 209 are not present. At this time, the stored object is heated in a limited region on the front side as viewed from the front face of refrigerator 100. It is desirable to provide a guidance such as a pattern indicating a heating position on the front side of the bottom surface of thawing compartment 105 for the user to recognize this region. Oscillation electrode 208 and counter electrode 209 may be embedded on the rear side as viewed from the front face of refrigerator 100, and the front side of refrigerator 100 may be a region where oscillation electrode 208 and counter electrode 209 are not present.

Figure 15:
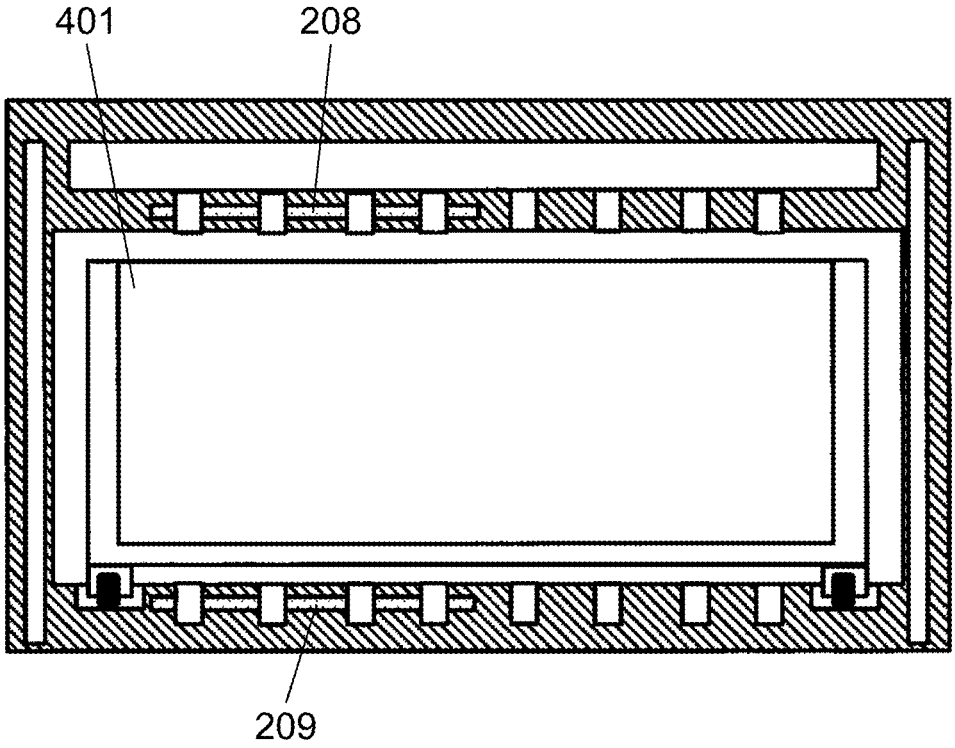
FIG. 15 is a diagram showing a modified example of thawing compartment 105.

A modified example of thawing compartment 105 will be further described. For example, as shown in FIG. 15, oscillation electrode 208 and counter electrode 209 may be embedded on the left side as viewed from the front face of refrigerator 100, and the right side of refrigerator 100 may be a region where oscillation electrode 208 and counter electrode 209 are not present. At this time, the stored object is heated in a limited region on the left side as viewed from the front face of refrigerator 100. It is desirable to provide a guidance such as a pattern indicating a heating position on the left side of the bottom surface of thawing compartment 105 for the user to recognize this region. Oscillation electrode 208 and counter electrode 209 may be embedded on the right side as viewed from the front face of refrigerator 100, and the left side of refrigerator 100 may be a region where oscillation electrode 208 and counter electrode 209 are not present.

Fifth Exemplary Embodiment

Figure 16:
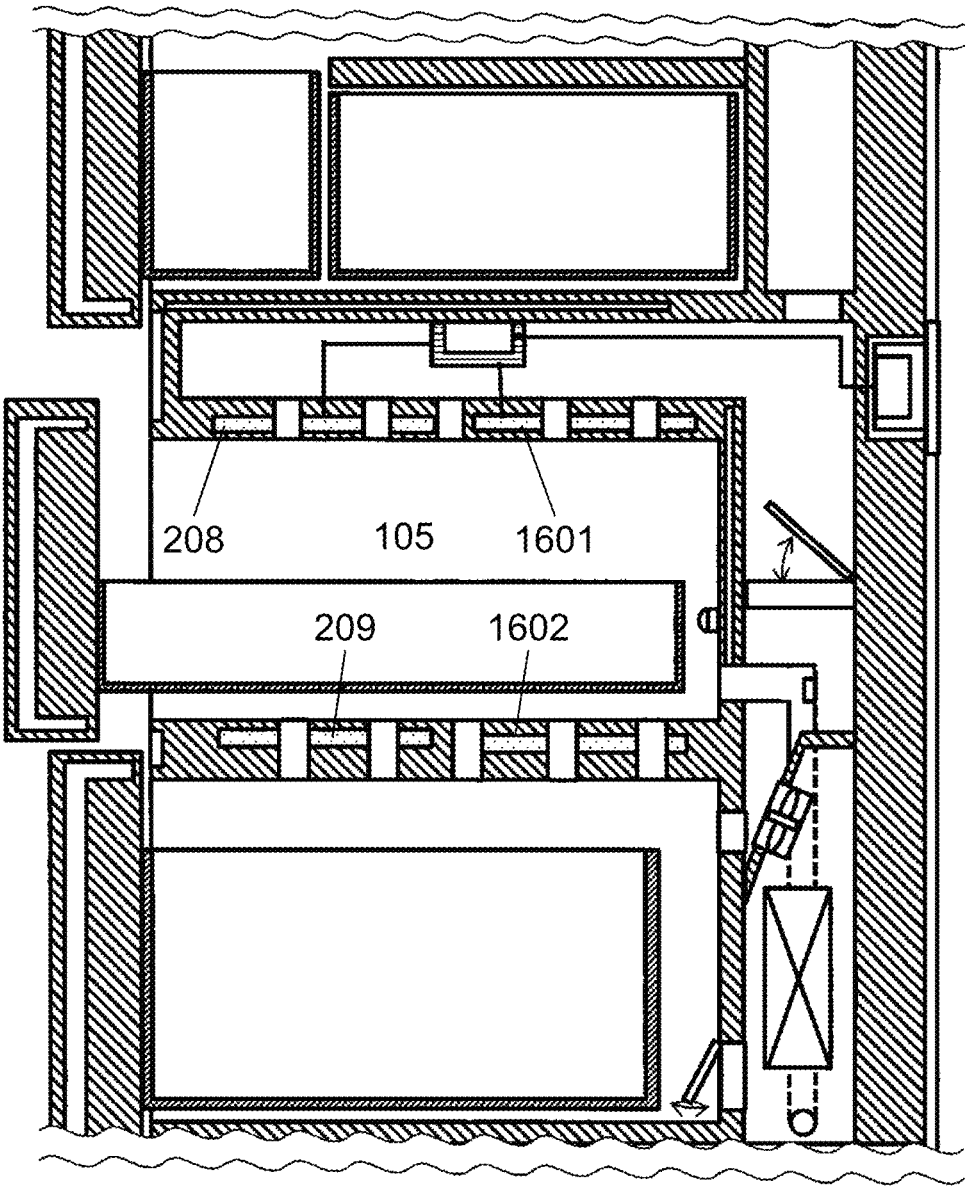
FIG. 16 is a diagram showing a modified example of thawing compartment 105.

In the present exemplary embodiment, a modified example of thawing compartment 105 will be described. In each of the above exemplary embodiments, an example has been described in which one set of oscillation electrode and counter electrode is provided in thawing compartment 105. However, a plurality of sets of oscillation electrodes and counter electrodes may be provided in thawing compartment 105. For example, as shown in FIG. 16, oscillation electrode 208 and counter electrode 209 may be embedded on the front side as viewed from the front face of refrigerator 100, and oscillation electrode 1601 and counter electrode 1602 may be embedded on the rear side as viewed from the front face of refrigerator 100. At this time, the stored object is heated in two regions on the front side and on the rear side as viewed from the front face of refrigerator 100. It is desirable to provide a guidance such as a pattern indicating a heating position on each of the front side and the rear side of the bottom surface of thawing compartment 105 for the user to distinguish between these two regions. The user needs to select one of the two regions on the front side and the rear side as viewed from the front face of refrigerator 100 that is used to thaw the stored object when the user inputs the execution instruction.

Figure 17:
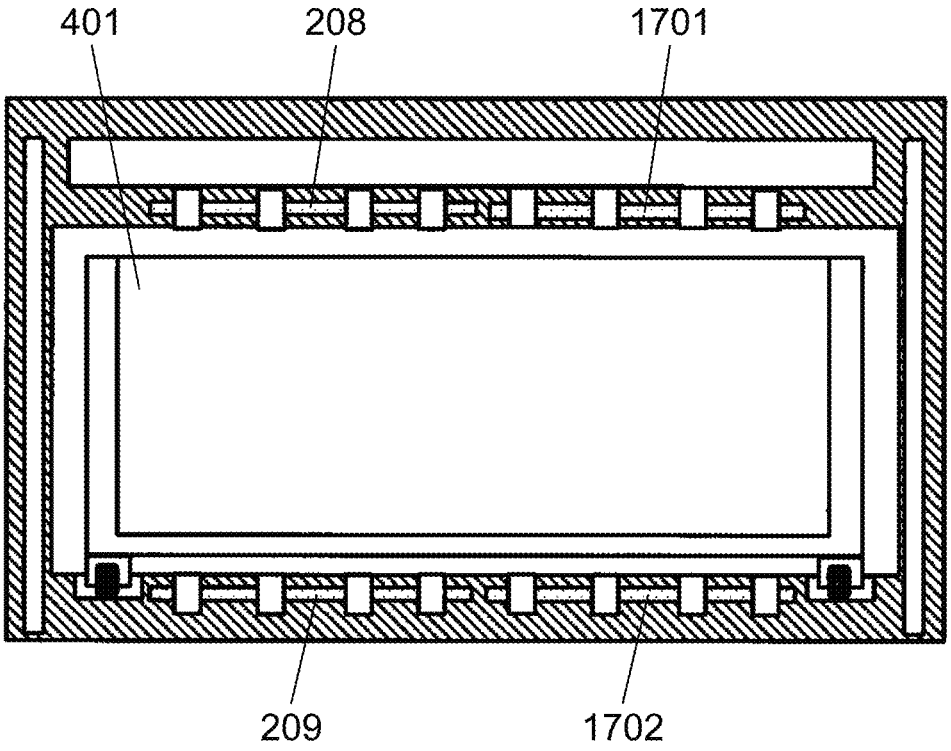
FIG. 17 is a diagram showing a modified example of thawing compartment 105.

A modified example of thawing compartment 105 will be further described. For example, as shown in FIG. 17, oscillation electrode 208 and counter electrode 209 may be embedded on the left side as viewed from the front face of refrigerator 100, and oscillation electrode 1701 and counter electrode 1702 may be embedded on the right side as viewed from the front face of refrigerator 100. At this time, the stored object is heated in two regions, the left side and the right side as viewed from the front face of refrigerator 100. It is desirable to provide a guidance such as a pattern indicating a heating position on each of the left side and the right side of the bottom surface of thawing compartment 105 for the user to distinguish between these two regions. The user needs to select one of the two regions on the left side and the right side as viewed from the front face of refrigerator 100 that is used to thaw the stored object when the user inputs the execution instruction.

Sixth Exemplary Embodiment

Figure 18:
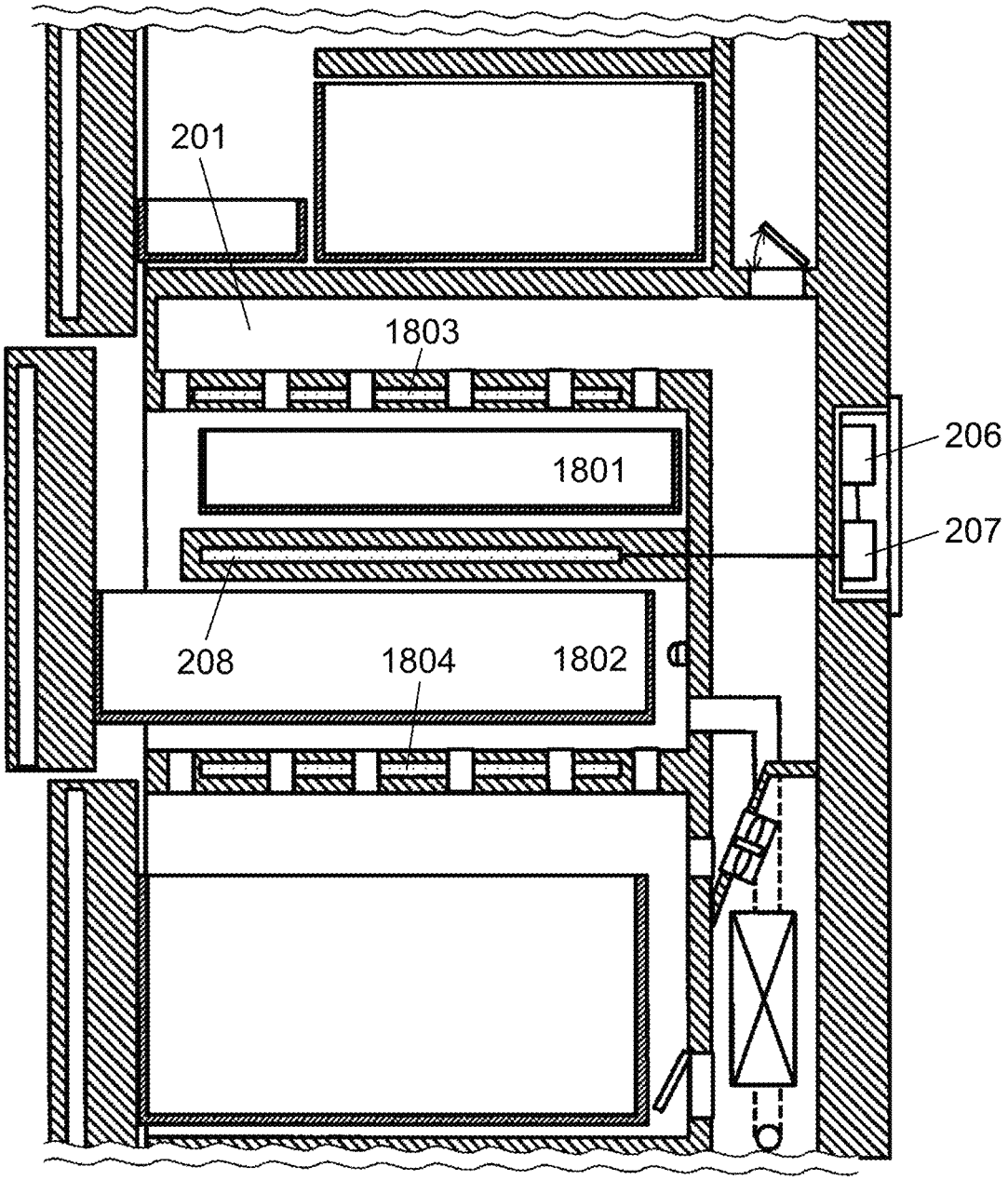
FIG. 18 is a diagram showing a modified example of thawing compartment 105.

In the present exemplary embodiment, a modified example of thawing compartment 105 will be described. For example, as shown in FIG. 18, thawing compartment 105 may be divided into upper thawing compartment 1801 and lower thawing compartment 1802. In the present exemplary embodiment, oscillation electrode 208 is embedded in a partition wall between upper thawing compartment 1801 and lower thawing compartment 1802, first counter electrode 1803 is embedded in a top surface of upper thawing compartment 1801, and second counter electrode 1804 is embedded in a bottom surface of lower thawing compartment 1802. An electric field formed between oscillation electrode 208 and first counter electrode 1803 heats the stored object placed in upper thawing compartment 1801. Further, an electric field formed between oscillation electrode 208 and second counter electrode 1804 heats the stored object placed in lower thawing compartment 1802. The user needs to select one of upper thawing compartment 1801 and lower thawing compartment 1802 that is used to thaw the stored object when the user inputs the execution instruction.

According to a configuration of the present exemplary embodiment, first counter electrode 1803 and second counter electrode 1804 can also be used as electromagnetic wave shields. This eliminates the need for separately providing an electromagnetic wave shield above air passage 201 such as electromagnetic wave shield 210 in FIG. 2.

Seventh Exemplary Embodiment

In the present exemplary embodiment, an example will be described in which oscillator 206 and matching unit 207 are installed in a storage compartment different from thawing compartment 105. Oscillator 206 and matching unit 207 may be installed, for example, inside refrigerating compartment 103 located above thawing compartment 105. In particular, it is desirable to install oscillator 206 and matching unit 207 near a water supply tank for ice making provided in refrigerating compartment 103 and a water supply pipe that supplies water from the water supply tank to an ice making machine. With such an arrangement, heat generated from oscillator 206 and matching unit 207 is conducted to the water supply pipe, thereby preventing the water supply pipe from freezing.

Eighth Exemplary Embodiment

Figure 19:
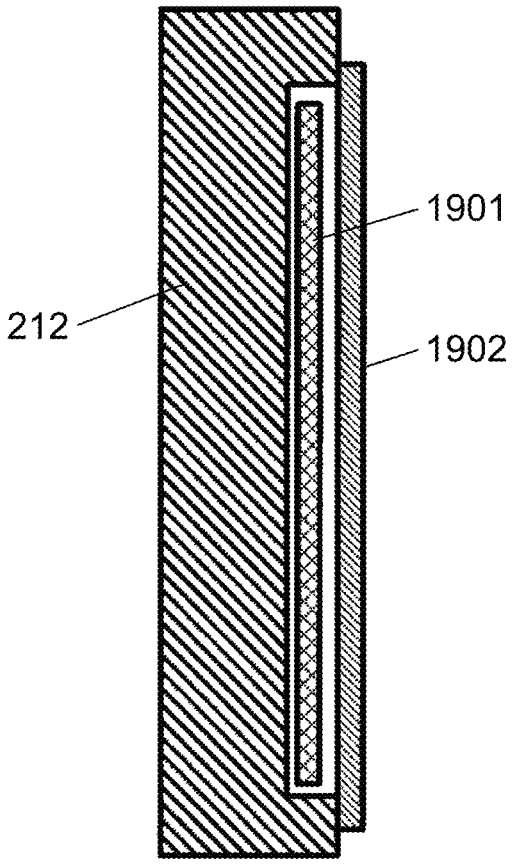
FIG. 19 is a diagram showing a modified example of an installation position of the electromagnetic wave shield.

In the present exemplary embodiment, a modified example of an installation position of the electromagnetic wave shield provided on door 212 will be described. FIG. 19 is a diagram showing door 212. Door 212 is provided with a recess on its side facing inside refrigerator 100, and this recess is provided with electromagnetic wave shield 1901. The recess is covered with resin plate 1902. According to the present exemplary embodiment, the electromagnetic wave shield can be easily incorporated into door 212 as compared with a case where the electromagnetic wave shield is provided inside the heat insulating material of door 212.

The present invention can be applied to household refrigerators and freezers, and commercial refrigerators and freezers.

REFERENCE MARKS IN THE DRAWINGS

100 refrigerator
103 refrigerating compartment
105 thawing compartment
208, 1601, 1701 oscillation electrode
209, 1602, 1702, 1803, 1804 counter electrode
210 electromagnetic wave shield
211 electromagnetic wave shield
212 door
213 electromagnetic wave shield
214 electromagnetic wave shield
215 electromagnetic wave shield
216 electromagnetic wave shield
1901 electromagnetic wave shield
217 door opening detection switch
601 controller

The invention claimed is:

1. A refrigerator configured to be capable of cooling a stored object and heating the stored object using an electromagnetic wave, the refrigerator comprising:
at least one storage chamber;
a first electrode provided on a top surface of a storage chamber among the at least one storage chamber;
a second electrode provided on a bottom surface of the storage chamber;
an air passage provided above the first electrode and through which cool air flows;
a first electromagnetic wave shield provided on a door of the storage chamber; and
a second electromagnetic wave shield provided in a housing part of the refrigerator, the housing part being in contact with the door while the door is closed,
wherein
the stored object placed between the first electrode and the second electrode is heated by the electromagnetic wave,
the first electrode includes an opening that introduces the cool air from the air passage into the storage chamber, and
while the door is closed, a distance between the first electromagnetic wave shield and the second electromagnetic wave shield is shorter than one quarter of a wavelength of the electromagnetic wave.

2. The refrigerator according to claim 1,
wherein
while the door is closed, the distance between the first electromagnetic wave shield and the second electromagnetic wave shield is less than or equal to 30 mm.

3. The refrigerator according to claim 1, wherein the second electromagnetic wave shield is grounded, and the first electromagnetic wave shield is not grounded.

4. The refrigerator according to claim 1, wherein the first electromagnetic wave shield is embedded inside the door.

5. The refrigerator according to claim 1, wherein the refrigerator includes a third electromagnetic wave shield provided between another storage chamber located above the storage chamber and the air passage, the another storage chamber being among the at least one storage chamber.

6. The refrigerator according to claim 5, wherein the another storage chamber is a refrigerating compartment.

7. The refrigerator according to claim 5, wherein the third electromagnetic wave shield has a mesh shape having a comb-shaped part at a position overlapping the opening.

8. The refrigerator according to claim 5, wherein the third electromagnetic wave shield is a thin plate including a conductive material and is grounded.

9. The refrigerator according to claim 8, wherein the third electromagnetic wave shield is a thin plate including metal or conductive resin.

10. The refrigerator according to claim 1, wherein
the refrigerator includes a refrigerating compartment provided at a top of the refrigerator, and
the storage chamber and an ice-making compartment are provided below the refrigerating compartment.

11. The refrigerator according to claim 1, wherein the refrigerator starts heating the stored object on a condition that a door of the storage chamber is closed.

12. The refrigerator according to claim 11, wherein the refrigerator stops heating the stored object when the door is opened after the refrigerator starts heating the stored object.

13. The refrigerator according to claim 1, wherein the refrigerator determines whether a door of the storage chamber is closed when the refrigerator receives an execution instruction to start heating the stored object from a user, the refrigerator starts heating the stored object upon determination that the door of the storage chamber is closed, and the refrigerator gives a predetermined notification to the user without starting heating the stored object upon determination that the door of the storage chamber is not closed.

14. The refrigerator according to claim 13, wherein the predetermined notification is a notification that prompts the user to close the door.

15. A refrigerator configured to be capable of cooling a stored object and heating the stored object using an electromagnetic wave, the refrigerator comprising:

at least one storage chamber;

a first electrode provided on a top surface of a storage chamber among the at least one storage chamber;

a second electrode provided on a bottom surface of the storage chamber;

an air passage provided above the first electrode and through which cool air flows a first electromagnetic wave shield provided on a door of the storage chamber; and a second electromagnetic wave shield provided in a housing part of the refrigerator, the housing part being in contact with the door while the door is closed, wherein the stored object placed between the first electrode and the second electrode is heated by the electromagnetic wave, the first electrode includes an opening that introduces the cool air from the air passage into the storage chamber, and while the door is closed, a distance between the first electromagnetic wave shield and the second electromagnetic wave shield is less than or equal to 30 mm.

* * * * *